US011129467B2

(12) United States Patent
Davancens

(10) Patent No.: US 11,129,467 B2
(45) Date of Patent: Sep. 28, 2021

(54) BRUSHES FOR DELIVERING GLUTINOUS SUBSTANCE TO WORKPIECE FROM END-EFFECTOR AND METHODS FOR MAKING AND USING THE SAME

(71) Applicant: The Boeing Company, Chicago, IL (US)

(72) Inventor: Angelica Davancens, Reseda, CA (US)

(73) Assignee: The Boeing Company, Chicago, IL (US)

( * ) Notice: Subject to any disclaimer, the term of this patent is extended or adjusted under 35 U.S.C. 154(b) by 130 days.

(21) Appl. No.: 16/696,914

(22) Filed: Nov. 26, 2019

(65) Prior Publication Data

US 2020/0093250 A1 Mar. 26, 2020

Related U.S. Application Data

(62) Division of application No. 15/143,172, filed on Apr. 29, 2016, now Pat. No. 10,524,562.
(Continued)

(51) Int. Cl.
*B05D 1/28* (2006.01)
*A46B 11/00* (2006.01)
(Continued)

(52) U.S. Cl.
CPC ..... *A46B 11/0072* (2013.01); *A46B 7/08* (2013.01); *A46B 9/025* (2013.01); *A46B 11/0006* (2013.01); *A46B 11/06* (2013.01); *A46B 11/063* (2013.01); *A46B 13/001* (2013.01); *A46B 13/008* (2013.01); *A46B 13/04* (2013.01);
(Continued)

(58) Field of Classification Search
None
See application file for complete search history.

(56) References Cited

U.S. PATENT DOCUMENTS 1,199,780 A 10/1916 Goodrich
1,314,441 A 8/1919 Stensrud
(Continued)

FOREIGN PATENT DOCUMENTS

CH 647709 2/1985
CN 87201146 1/1988
(Continued)

OTHER PUBLICATIONS

Japanese Office Action concerning Japanese Patent Application No. 2016-199906 dated Dec. 1, 2020.
(Continued)

*Primary Examiner* — Charles Capozzi
(74) *Attorney, Agent, or Firm* — Kunzler Bean & Adamson

(57) ABSTRACT

A method of delivering a glutinous substance to a workpiece from an end-effector comprises using the end-effector to rotate a brush relative to the workpiece about a rotational axis. The method also comprises, while rotating the brush relative to the workpiece about the rotational axis, urging the glutinous substance from the end-effector through a channel of a body of the brush from an axial inlet of the channel to an outlet of the channel, into contact with a thatch of bristles of the brush. Additionally, the method comprises using the end-effector to position the brush relative to the workpiece such that the glutinous substance in contact with the thatch is delivered onto at least a first surface and a third surface of the workpiece.

20 Claims, 11 Drawing Sheets

Related U.S. Application Data

(60) Provisional application No. 62/242,216, filed on Oct. 15, 2015.

(51) Int. Cl.

| | |
|---|---|
| ***A46B 13/04*** | (2006.01) |
| ***A46B 11/06*** | (2006.01) |
| ***A46B 7/08*** | (2006.01) |
| ***A46B 9/02*** | (2006.01) |
| ***A46B 13/00*** | (2006.01) |
| ***B05C 1/06*** | (2006.01) |
| ***B05C 1/16*** | (2006.01) |
| ***A46D 3/00*** | (2006.01) |

(52) U.S. Cl.

CPC ..... *A46D 3/00* (2013.01); *B05C 1/06* (2013.01); *B05C 1/16* (2013.01); *B05D 1/28* (2013.01); *A46B 2200/20* (2013.01)

(56) References Cited

U.S. PATENT DOCUMENTS

| | | | |
|---|---|---|---|
| 1,330,001 | A | 2/1920 | Swanson |
| 1,465,856 | A | 8/1923 | Marsh |
| 1,475,079 | A | 11/1923 | Miller |
| 1,979,240 | A | 11/1934 | Adelmann |
| 2,064,318 | A | 12/1936 | Platt et al. |
| 2,227,792 | A | 1/1941 | Norton |
| 2,321,961 | A | 6/1943 | Wilde |
| 2,590,977 | A | 4/1952 | Gordon |
| 2,747,217 | A | 5/1956 | Stahl |
| 2,859,564 | A | 11/1958 | Farmer et al. |
| 3,425,080 | A | 2/1969 | Dolitzsch et al. |
| 3,860,987 | A | 1/1975 | Bolli et al. |
| 3,872,533 | A | 3/1975 | Proffit |
| 3,994,041 | A | 11/1976 | Barber |
| 4,570,282 | A | 2/1986 | Martin et al. |
| 4,881,289 | A | 11/1989 | Nagata et al. |
| 5,027,463 | A | 7/1991 | Daub |
| 5,171,095 | A | 12/1992 | Davies et al. |
| 6,409,103 | B1 | 6/2002 | Norville |
| 6,722,956 | B2 | 4/2004 | Ouyama et al. |
| 7,386,911 | B2 | 6/2008 | Stoll |
| 8,651,046 | B1 | 2/2014 | Davancens et al. |
| 2004/0255410 | A1 | 12/2004 | Schonewille |
| 2005/0003077 | A1 | 1/2005 | Kamata et al. |
| 2007/0026773 | A1 | 2/2007 | Vogel |
| 2007/0050938 | A1 | 3/2007 | Rosenzweig et al. |
| 2009/0080964 | A1 | 3/2009 | Castellana |
| 2015/0064357 | A1 | 3/2015 | Tomuta et al. |
| 2017/0105512 | A1 | 4/2017 | Tomuta et al. |
| 2017/0105514 | A1 | 4/2017 | Tomuta et al. |
| 2017/0106538 | A1 | 4/2017 | Tomuta et al. |
| 2020/0008569 | A1 | 1/2020 | Tomuta et al. |
| 2020/0030841 | A1 | 1/2020 | Tomuta et al. |
| 2020/0093250 | A1 | 3/2020 | Davancens et al. |

FOREIGN PATENT DOCUMENTS

| | | | |
|---|---|---|---|
| CN | 104415878 | | 3/2015 |
| DE | 3320598 | | 12/1984 |
| DE | 3634018 | | 10/1986 |
| DE | 102006050722 | | 4/2008 |
| DE | 102008014358 | | 10/2009 |
| DE | 102008039804 | | 2/2010 |
| EP | 0444436 | A2 | 9/1991 |
| EP | 0925742 | A2 | 6/1999 |
| EP | 2842457 | | 3/2015 |
| JP | 2001353611 | | 12/2001 |
| JP | 201547602 | | 3/2015 |
| JP | 2019107747 | | 7/2019 |
| KR | 10-2009-0013973 | | 2/2009 |
| WO | 03070051 | A1 | 8/2003 |

OTHER PUBLICATIONS

Office Action for Canadian Patent Application No. 2945420 dated Jul. 14, 2020.

Extended European Search Report concerning European Patent Application No. 20168265.5 dated Aug. 3, 2020.

Japanese Office Action concerning Japanese Patent Application No. 2016-199906 dated Jul. 30, 2020.

Office Action for Chinese Patent Application No. 201610885791.X dated Feb. 3, 2020.

Aerospace Dispensing Systems, Fori's New Aerospace Division Blog dated Oct. 3, 2013, http://fori-aerospace.blogspot.com/2013/10/aerospace-dispensing-systems.html, Fori Automation, Inc., accessed Jun. 2, 2016.

Extended European Search Report for EP Application No. 16193053.2 dated Mar. 2, 2017.

Extended European Search Report for EP Application No. 16193055.7 dated Mar. 6, 2017.

Office Action for Chinese Patent Application No. 201610885794.3 dated May 14, 2019.

Office Action for Canadian Patent Application No. 2,945,420 dated Oct. 11, 2019.

Office Action for Chinese Patent Application No. 201610885794.3 dated Sep. 20, 2019.

U.S. Appl. No. 16/548,689, filed Aug. 22, 2019.

U.S. Appl. No. 16/513,695, filed Jul. 16, 2019.

Office Action for Brazlian Patent Application No. BR102016023781-5 dated Feb. 6, 2020.

Office Action for Brazlian Patent Application No. BR102016023775-0 dated Mar. 25, 2020.

Office Action for Canadian Patent Application No. 2945362 dated Apr. 17, 2020.

Office Action for Canadian Patent Application No. 2,945,420 dated Nov. 6, 2019.

Brazilian Office Action concerning Brazilian Patent Application No. BR102016023781-5 dated Jul. 16, 2021.

BRUSHES FOR DELIVERING GLUTINOUS SUBSTANCE TO WORKPIECE FROM END-EFFECTOR AND METHODS FOR MAKING AND USING THE SAME

BACKGROUND

It is commonplace to apply glutinous substances, such as sealants, adhesives, and fillers, to surfaces of structures or other objects for purposes of sealing, corrosion resistance, and/or fixation, among others. However, surface application of glutinous substances in an efficient, predictable, and uniform manner using manual techniques is difficult and time consuming.

SUMMARY

Accordingly, apparatuses and methods, intended to address at least the above-identified concerns, would find utility.

The following is a non-exhaustive list of examples, which may or may not be claimed, of the subject matter according to the present disclosure.

One example of the subject matter according to the present disclosure relates to a brush for delivering a glutinous substance to a workpiece from an end-effector. The brush comprises a body having a rotational axis. The body comprises a first end, a second end, opposite the first end, and a channel, comprising an axial inlet and an outlet. The axial inlet is at the first end of the body and is coaxial with the rotational axis. The brush also comprises bristles, extending from the body so that the bristles are not parallel to the rotational axis of the body.

Another example of the subject matter according to the present disclosure relates to a method of making a brush. The method comprises attaching bristles to a body such that the bristles are not parallel to a rotational axis of the body. The body comprises a first end, a second end, opposite the first end, and a channel, comprising an axial inlet and an outlet. The axial inlet is at the first end of the body and is coaxial with the rotational axis. The method also comprises removing first portions of at least a plurality of the bristles to form a thatch, comprising a frusto-conical portion and a cylindrical portion.

Yet another example of the subject matter according to the present disclosure relates to a method of delivering a glutinous substance to a workpiece from an end-effector. The workpiece comprises a first surface, a second surface, spaced a normal distance from the first surface, and a third surface, separating the first surface from the second surface. The method comprises using the end-effector to rotate a brush relative to the workpiece about a rotational axis. The brush comprises a body, comprising a first end, a second end, opposing the first end, and a channel, comprising an axial inlet and an outlet. The axial inlet is at the first end of the body and is coaxial with the rotational axis. The brush also comprises bristles, extending from the body so that the bristles are not parallel to the rotational axis of the body. The bristles are arranged into a thatch, comprising a frusto-conical portion, a cylindrical portion, a boundary between the frusto-conical portion and the cylindrical portion, and a crown, which is opposite the first end of the body. The cylindrical portion of the thatch terminates at the crown of the thatch. The method also comprises, while rotating the brush relative to the workpiece about the rotational axis, urging the glutinous substance from the end-effector through the channel of the body of the brush from the axial inlet of the channel to the outlet of the channel, into contact with the thatch. Additionally, the method comprises using the end-effector to position the brush relative to the workpiece such that the glutinous substance in contact with the thatch is delivered onto at least the first surface and the third surface of the workpiece.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of a brush for delivering a glutinous substance to a workpiece from an end-effector, according to one or more examples of the present disclosure;

FIG. 2 is a schematic, cross-sectional side elevation view of the brush of FIG. 1, according to one or more examples of the present disclosure;

FIG. 3 is a schematic, perspective view of the brush of FIG. 1, delivering glutinous substance to a workpiece, according to one or more examples of the present disclosure;

FIG. 4 is a schematic, cross-sectional side elevation view of the brush of FIG. 1, delivering glutinous substance to a workpiece, according to one or more examples of the present disclosure;

FIG. 5 is a schematic, cross-sectional side elevation view of the brush of FIG. 1, according to one or more examples of the present disclosure;

FIG. 6 is a schematic, cross-sectional side elevation view of the brush of FIG. 1, according to one or more examples of the present disclosure;

FIG. 7 is a schematic, perspective view of the brush of FIG. 1, delivering glutinous substance to a workpiece, according to one or more examples of the present disclosure;

FIG. 8 is a schematic, perspective view of the brush of FIG. 1, according to one or more examples of the present disclosure;

FIG. 9 is a schematic, cross-sectional side elevation view of the brush of FIG. 1, according to one or more examples of the present disclosure;

FIG. 10 is a schematic, bottom plan view of the brush of FIG. 1, according to one or more examples of the present disclosure;

FIG. 11 is a schematic, perspective view of the brush of FIG. 1, according to one or more examples of the present disclosure;

Figure 1:
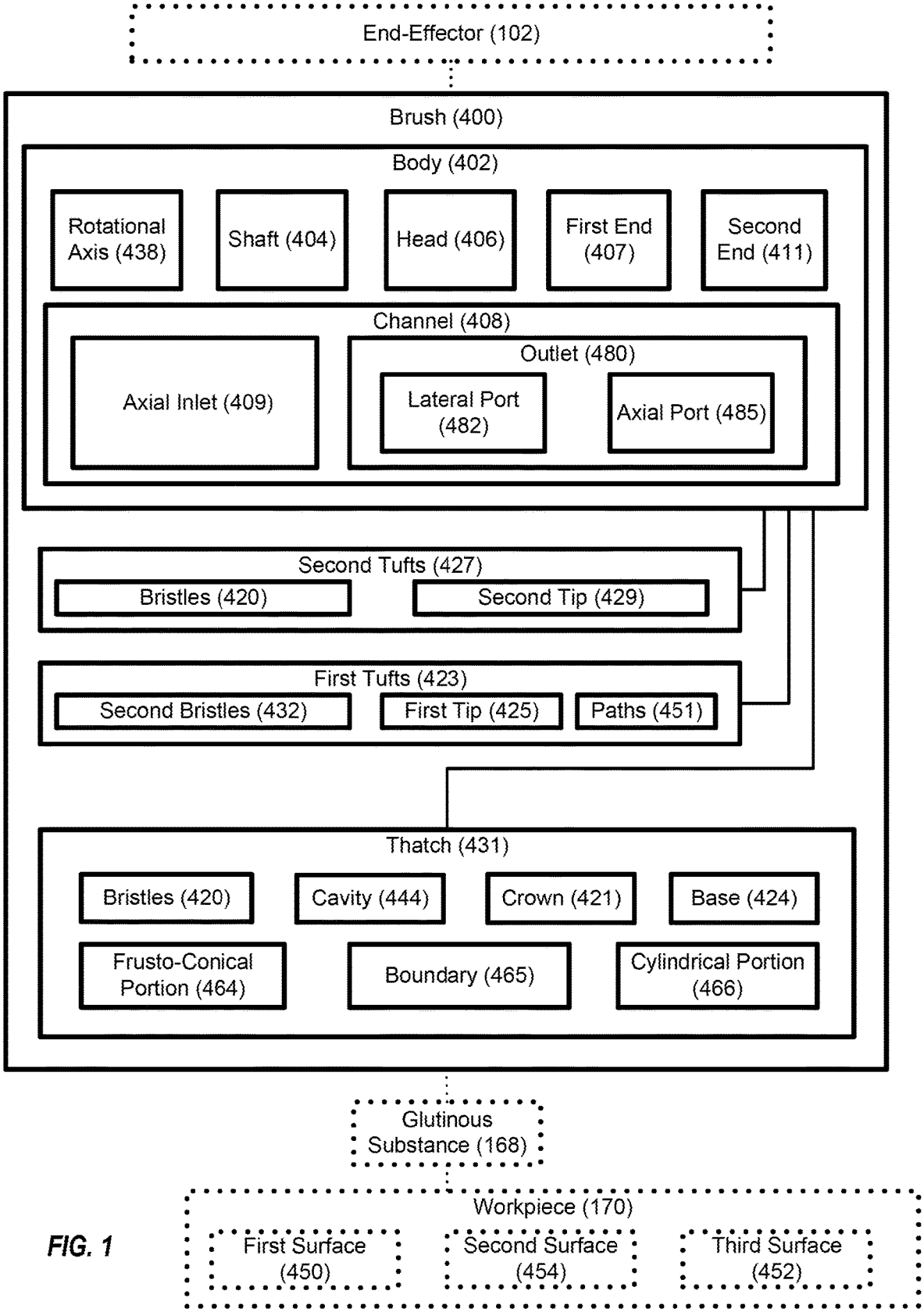
Figure 12:
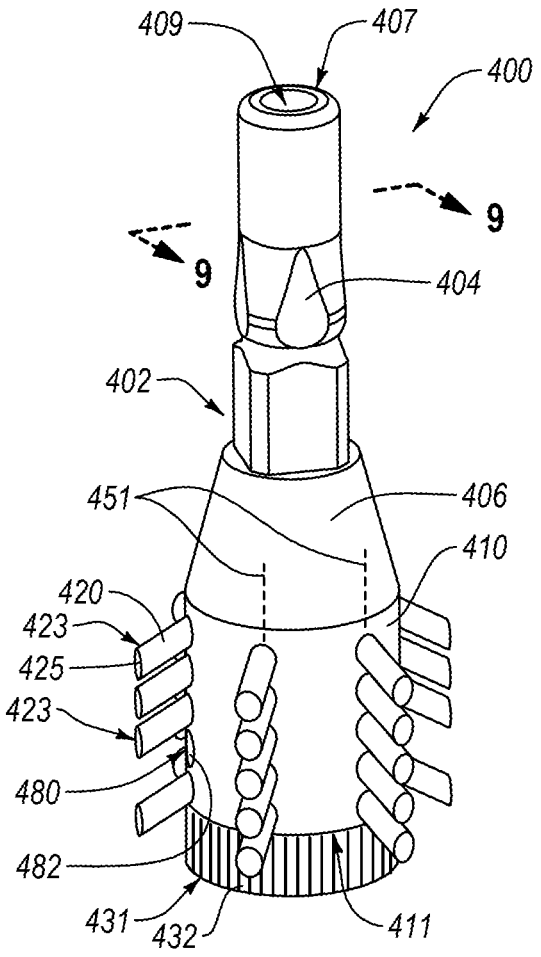
Figure 13:
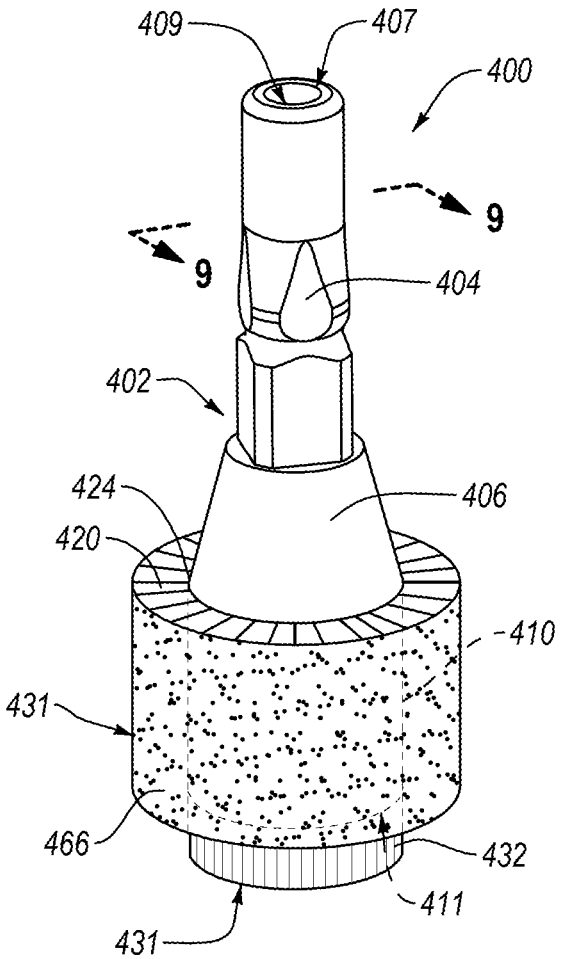
Figure 14:
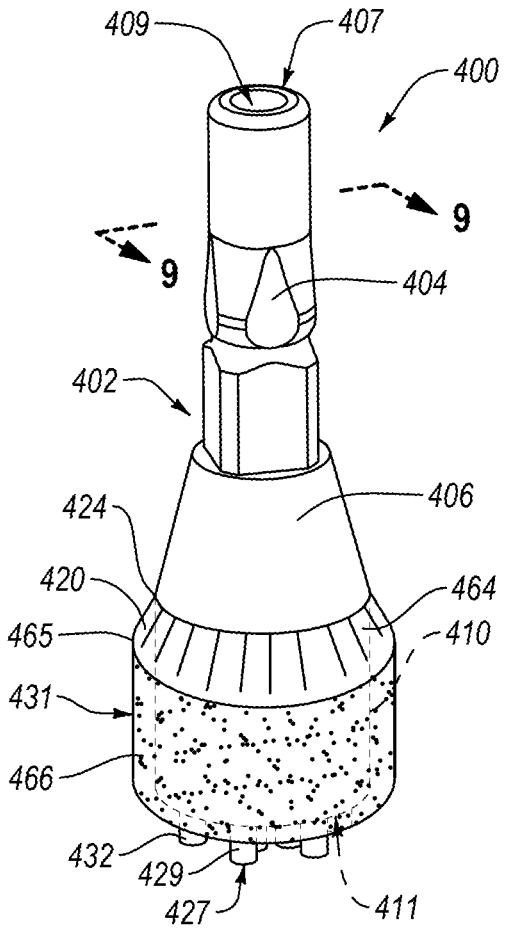
Figure 15:
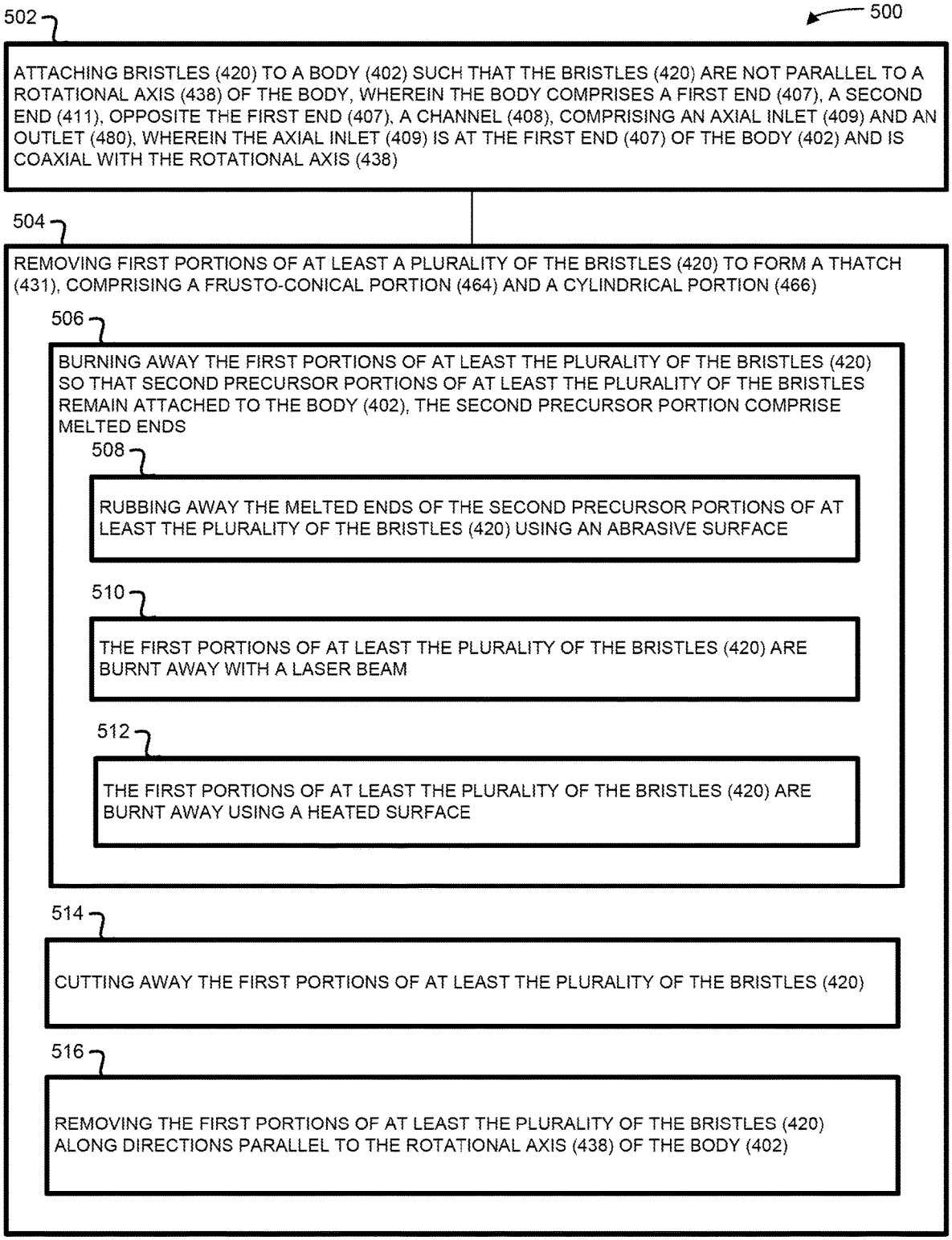
Figure 16:
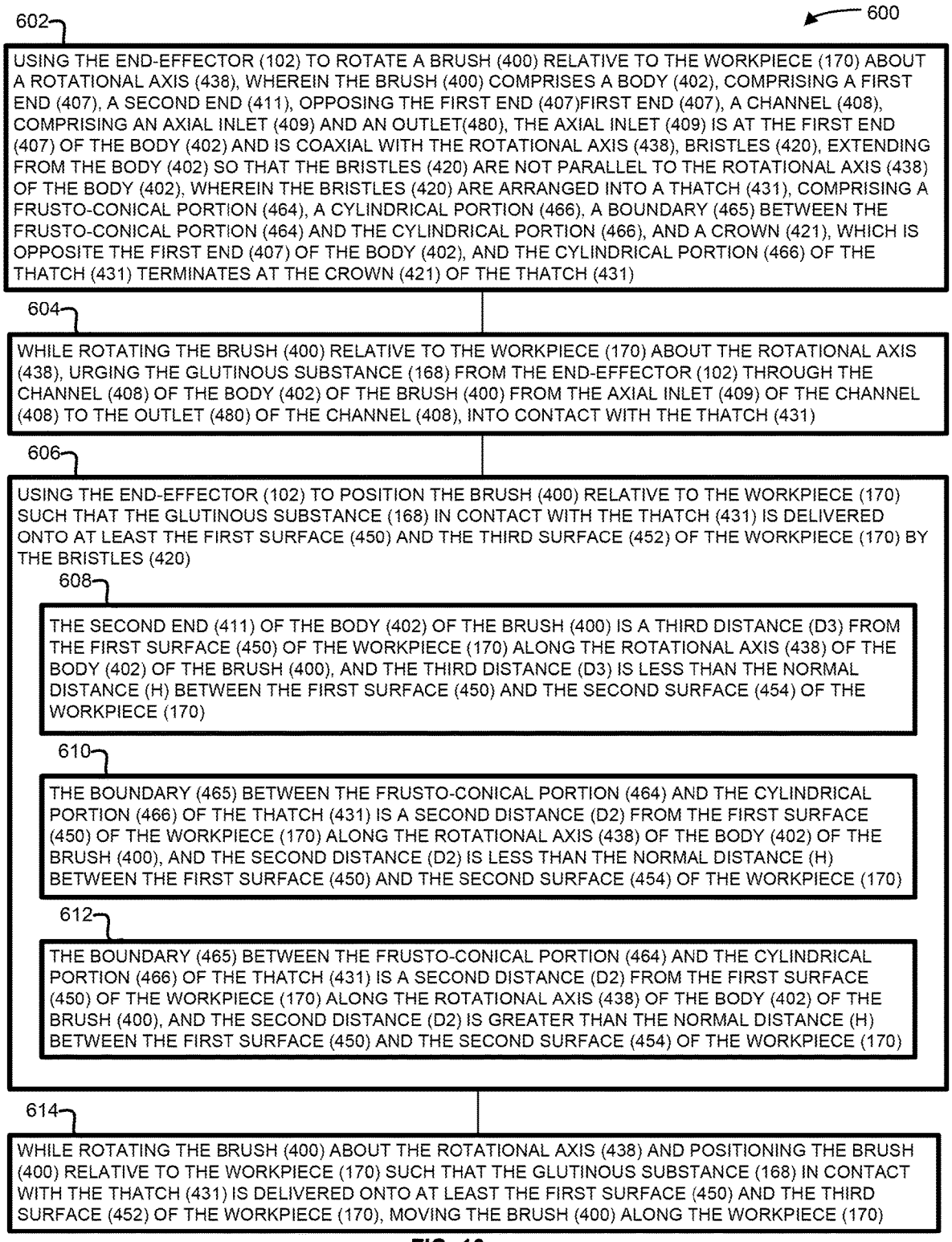
Figure 17:
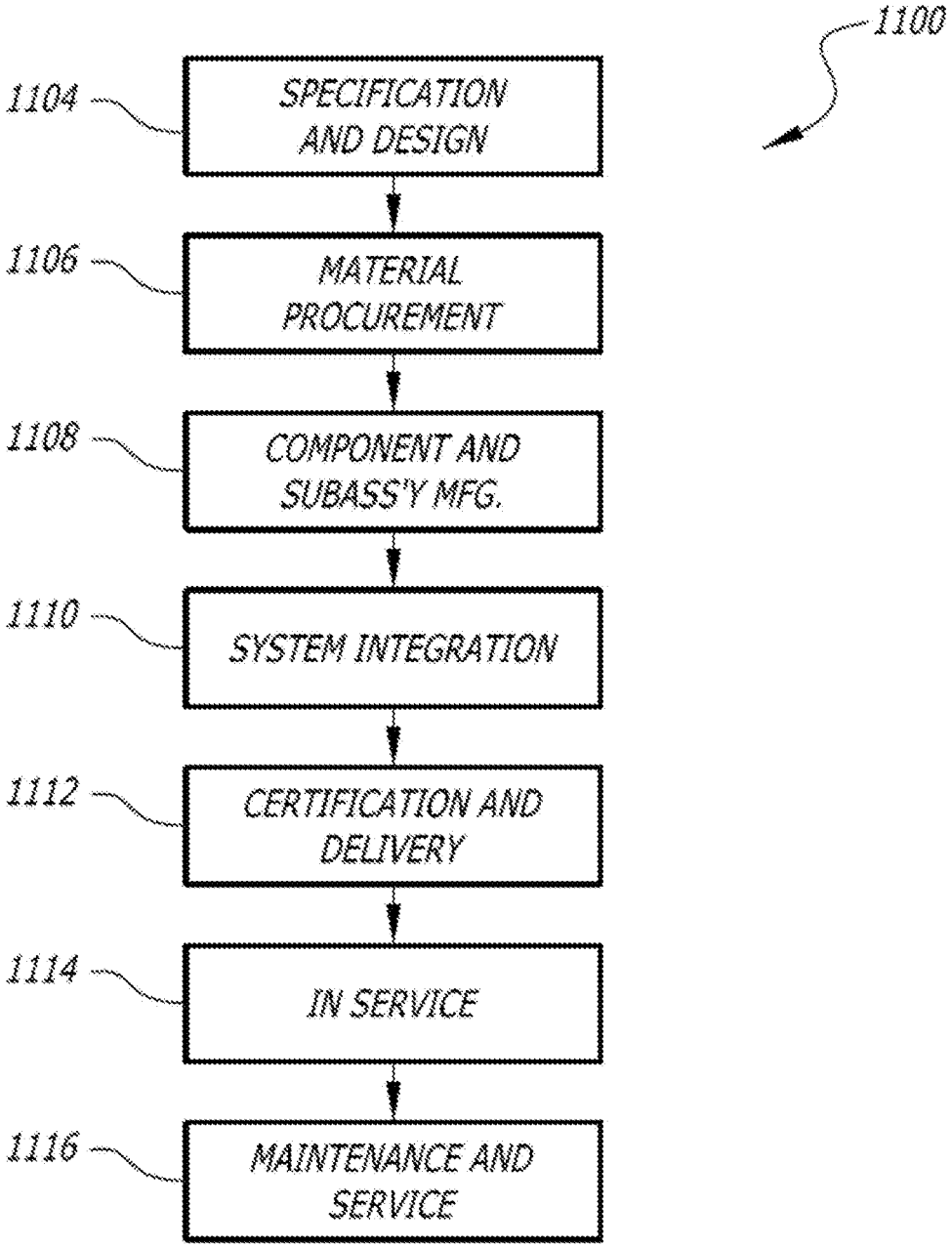
Figure 18:
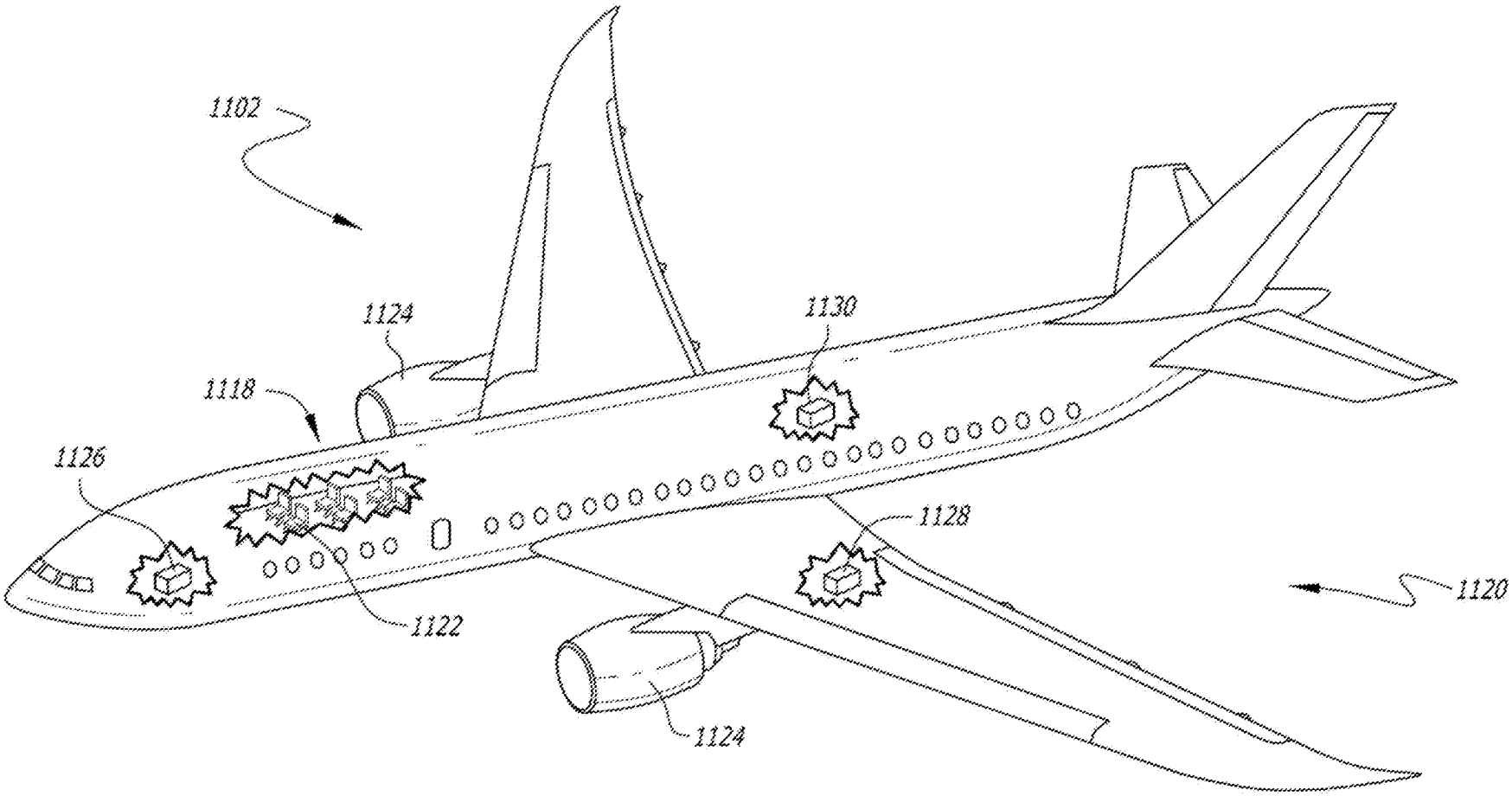

FIG. 12 is a schematic, perspective view of the brush of FIG. 1, according to one or more examples of the present disclosure;

FIG. 13 is a schematic, perspective view of the brush of FIG. 1, according to one or more examples of the present disclosure;

FIG. 14 is a schematic, perspective view of the brush of FIG. 1, according to one or more examples of the present disclosure;

FIG. 15 is a block diagram of a method of making a brush, according to one or more examples of the present disclosure;

FIG. 16 is a block diagram of a method of delivering a glutinous substance to a workpiece from an end-effector, according to one or more examples of the present disclosure;

FIG. 17 is a block diagram of aircraft production and service methodology; and FIG. 18 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 15, 16, and 17, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 15, 16, and 17 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIG. 1 and particularly to, e.g., FIGS. 2-14, brush 400 for delivering glutinous substance 168 to workpiece 170 from end-effector 102 is disclosed. Brush 400 comprises body 402, having rotational axis 438. Body 402 comprises first end 407, second end 411, opposite first end 407, and channel 408, comprising axial inlet 409 and outlet 480. Axial inlet 409 is at first end 407 of body 402 and is coaxial with rotational axis 438. Brush 400 also comprises bristles 420, extending from body 402 so that bristles 420 are not parallel to rotational axis 438 of body 402. The preceding subject matter of this paragraph characterizes example 1 of the present disclosure.

Brush 400 is configured to facilitate ease and efficiency associated with the application of glutinous substances onto surfaces of workpieces. Axial inlet 409, being coaxial with rotational axis 438, allows flow of glutinous substance 168 through channel 408 as brush 400 rotates about rotational axis 438. Bristles 420, extending from body 402 so that bristles 420 are not parallel to rotational axis 438 of body 402, promote concurrent application of glutinous substance 168 onto non-coplanar surfaces.

First end 407 of body 402 may be a planar or a curved surface, generally perpendicular to rotational axis 438. Likewise, second end 411 of body 402 may be a planar or a curved surface, generally perpendicular to rotational axis 438.

In one example, body 402 has a one-piece monolithic construction. In such an example, body 402 can be made of metal. In yet some examples, body 402 can have a multi-piece construction. According to certain examples, body 402 includes shaft 404, configured to be coupled to end-effector 102. In one example, shaft 404 is made of metal.

Referring generally to FIG. 1 and particularly to, e.g., FIGS. 5, 6, 9, and 10, outlet 480 of channel 408 of body 402 comprises axial port 485, located at second end 411 of body 402. Axial port 485 is coaxial with rotational axis 438 of body 402. The preceding subject matter of this paragraph characterizes example 2 of the present disclosure, wherein example 2 also includes the subject matter according to example 1, above.

Axial port 485 of outlet 480 of channel 408, being coaxial with rotational axis 438 of body 402, promotes flow of glutinous substance 168 from outlet 480 of channel 408 in direction coaxial with rotational axis 438 of body 402. In one example, axial port 485 of outlet 480 of channel 408, being coaxial with rotational axis 438 of body 402, facilitates delivery of glutinous substance 168 from outlet 480 of channel 408 to crown 421 of thatch 431 or second tips 429 of second tufts 427.

Referring generally to FIG. 1 and particularly to, e.g., FIGS. 2-5 and 8-12, outlet 480 of channel 408 of body 402 comprises lateral port 482 between first end 407 of body 402 and second end 411 of body 402. The preceding subject matter of this paragraph characterizes example 3 of the present disclosure, wherein example 3 also includes the subject matter according to any one of examples 1 or 2, above.

Lateral port 482 of outlet 480 of channel 408, being between first end 407 of body 402 and second end 411 of body 402, promotes flow of glutinous substance 168 from outlet 480 of channel 408 to portions of bristles 420 between crown 421 of thatch 431 and base 424 of thatch 431 or to first tufts 423.

Referring generally to FIG. 1 and particularly to, e.g., FIGS. 2-5 and 8-12, lateral port 482 is one of oblique or perpendicular to rotational axis 438 of body 402. The preceding subject matter of this paragraph characterizes example 4 of the present disclosure, wherein example 4 also includes the subject matter according to example 3, above.

Lateral port 482 of outlet 480 of channel 408, being one of oblique or perpendicular to rotational axis 438 of body 402, promotes flow of glutinous substance 168 from outlet 480 of channel 408 in a direction oblique or perpendicular to rotational axis 438 of body 402. Directing flow of glutinous substance 168 from outlet 480 of channel 408 in a direction oblique or perpendicular to rotational axis 438 of body 402 helps to distribute glutinous substance 168 to radially outward extents of bristles 420 away from rotational axis 438.

In some examples, outlet 480 may comprise multiple lateral ports 482.

Referring generally to FIG. 1 and particularly to, e.g., FIGS. 2-7, bristles 420 are arranged into thatch 431 that comprises crown 421, which is opposite first end 407 of body 402, and base 424, located between crown 421 and first end 407 of body 402. Additionally, thatch 431 comprises frusto-conical portion 464 that originates at base 424 of thatch 431 and cylindrical portion 466 that terminates at crown 421 of thatch 431. Cylindrical portion 466 is contiguous with frusto-conical portion 464. Thatch 431 further comprises boundary 465 between frusto-conical portion 464 and cylindrical portion 466. The preceding subject matter of this paragraph characterizes example 5 of the present disclosure, wherein example 5 also includes the subject matter according to any one of examples 1 to 4, above.

Frusto-conical portion 464 and cylindrical portion 466 of thatch 431 facilitate delivery of glutinous substance 168 to non-coplanar surfaces of workpiece 170. More specifically, in one example, frusto-conical portion 464 promotes delivery of glutinous substance 168 to second surface 454 of workpiece 170, and cylindrical portion 466 promotes delivery of glutinous substance 168 to first surface 450 and third surface 452 of workpiece 170, where third surface 452 of workpiece 170 separates first surface 450 of workpiece 170 from second surface 454 of workpiece 170. Base is defined as a perimeter or boundary of a circular area.

Referring generally to FIG. 1 and particularly to, e.g., FIGS. 2-7, frusto-conical portion 464 of thatch 431 diverges toward cylindrical portion 466 of thatch 431. The preceding subject matter of this paragraph characterizes example 6 of the present disclosure, wherein example 6 also includes the subject matter according to example 5, above.

Divergence of frusto-conical portion 464 of thatch 431 toward cylindrical portion 466 of thatch 431 allows for delivery of glutinous substance 168 to second surface 454 of workpiece 170 while glutinous substance 168 is being delivered to first surface 450 and third surface 452 of workpiece 170.

Referring generally to FIG. 1 and particularly to, e.g., FIGS. 2-7, a difference, in any plane perpendicular to rotation axis 438 and intersecting thatch 431 and body 402, between first radius RB of thatch 431 and second radius RT of a portion of body 402, from which bristles 420 extend, increases from base 424 of thatch 431 in a direction along rotational axis 438 toward crown 421 of thatch 431. The preceding subject matter of this paragraph characterizes example 7 of the present disclosure, wherein example 7 also includes the subject matter according to example 6, above.

The increase in the difference, in any plane perpendicular to rotation axis 438 and intersecting thatch 431 and body 402, between first radius RB of thatch 431 and second radius RT of a portion of body 402, from base 424 of thatch 431 in a direction along rotational axis 438 toward crown 421 of thatch 431 allows for delivery of glutinous substance 168 to first surface 450, second surface 454, and third surface 452 of workpiece 170 while reducing potential for impact between body 402 and third surface 452 of workpiece 170.

Figure 2:
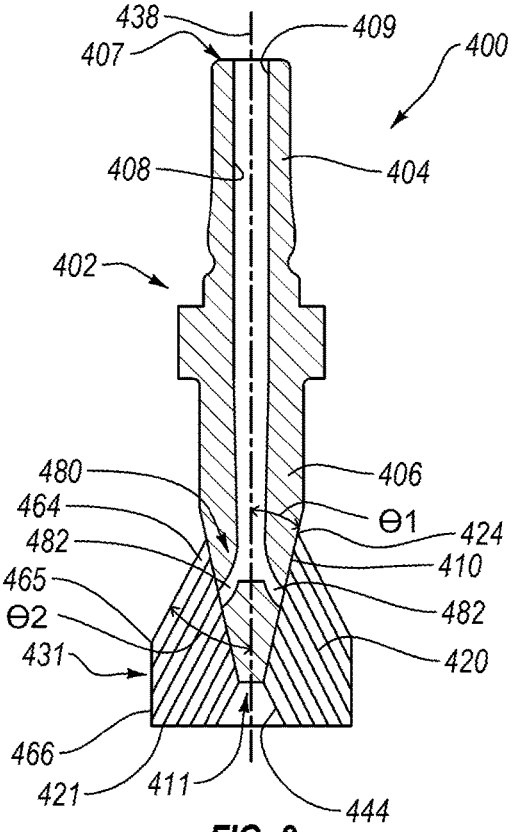
Figure 3:
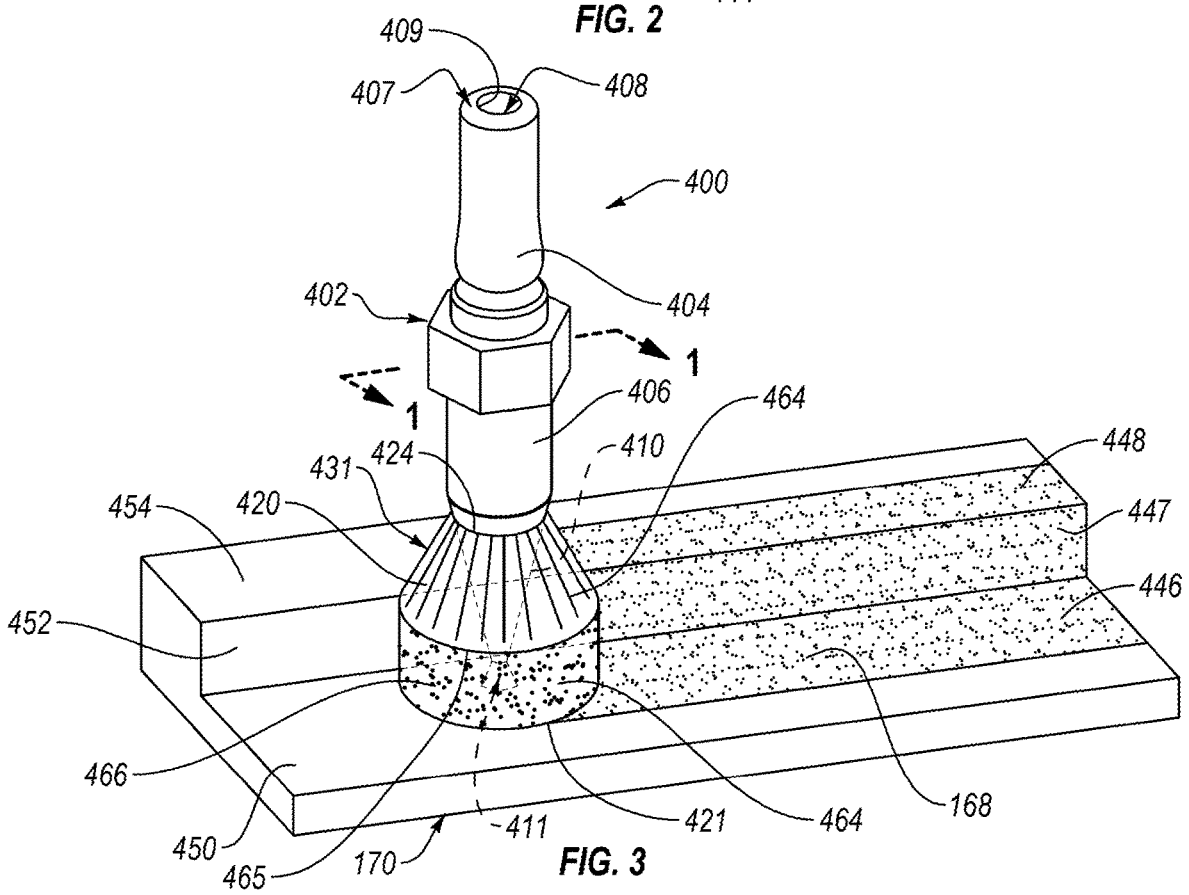
Figure 4:
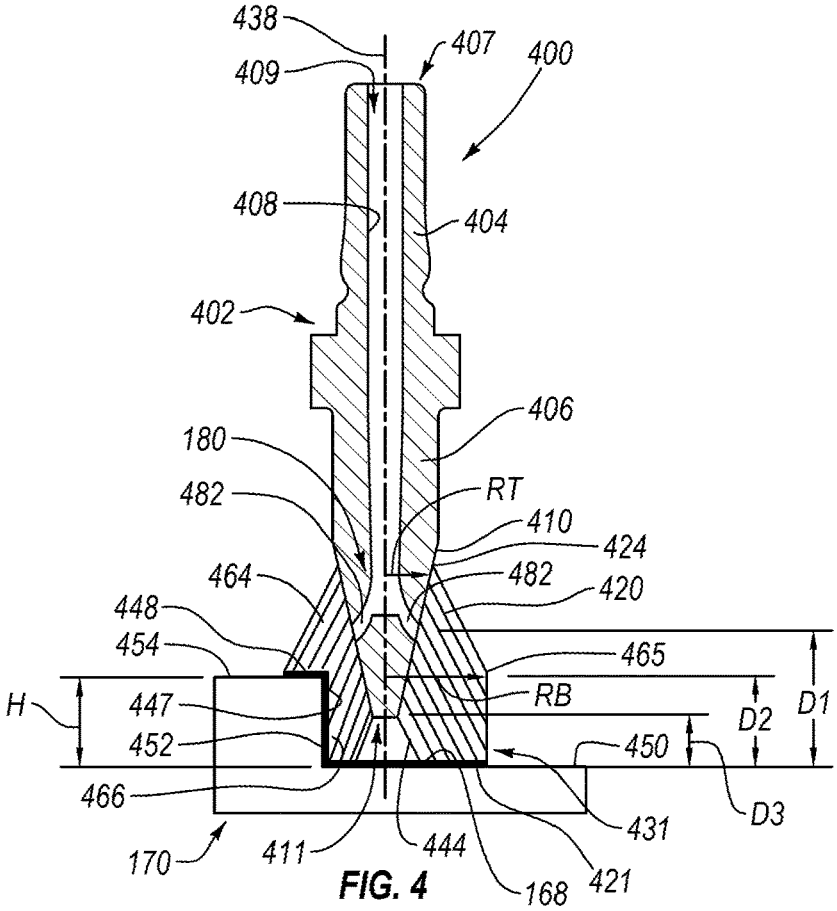
Figure 5:
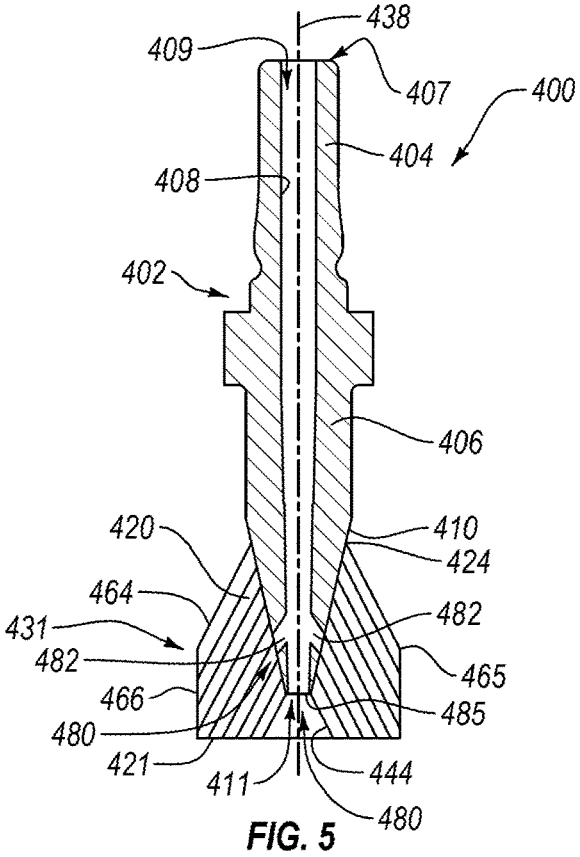

Referring generally to FIG. 1 and particularly to, e.g., FIGS. 2, 4, and 5, outlet 480 of channel 408 of body 402 comprises lateral port 482 between first end 407 of body 402 and second end 411 of body 402. Lateral port 482 is between base 424 of thatch 431 and crown of thatch 431. The preceding subject matter of this paragraph characterizes example 8 of the present disclosure, wherein example 8 also includes the subject matter according to any one of examples 5 to 7, above.

Lateral port 482 of outlet 480 of channel 408, being between base 424 of thatch 431 and crown of thatch 431, promotes flow of glutinous substance 168 from outlet 480 of channel 408 to portions of bristles 420 between crown 421 of thatch 431 and base 424 of thatch 431.

Referring generally to FIG. 1 and particularly to, e.g., FIGS. 2 and 4, lateral port 482 is between base 424 of thatch 431 and boundary 465. The preceding subject matter of this paragraph characterizes example 9 of the present disclosure, wherein example 9 also includes the subject matter according to example 8, above.

Lateral port 482 of outlet 480 of channel 408, being between base 424 of thatch 431 and boundary of thatch 431, promotes flow of glutinous substance 168 from outlet 480 of channel 408 to portions of bristles 420 forming at least frusto-conical 464 portion 464 of thatch 431.

Referring generally to FIG. 1 and particularly to, e.g., FIG. 5, lateral port 482 is between boundary 465 and crown 421 of thatch 431. The preceding subject matter of this paragraph characterizes example 10 of the present disclosure, wherein example 10 also includes the subject matter according to example 8, above.

Lateral port 482 of outlet 480 of channel 408, being between boundary of thatch 431 and crown 421 of thatch 431, promotes flow of glutinous substance 168 from outlet 480 of channel 408 to portions of bristles 420 forming at least cylindrical portion 466 of thatch 431 at locations between boundary 465 and crown 421 of thatch 431.

Referring generally to FIG. 1 and particularly to, e.g., FIGS. 5, 6, 9, and 10, outlet 480 of channel 408 of body 402 comprises axial port 485, located at second end 411 of body 402. Axial port 480 is coaxial with rotational axis 438 of body 402. Thatch 431 further comprises cavity 444, coaxial with rotational axis 438. Axial port 485 opens into cavity 444. The preceding subject matter of this paragraph characterizes example 11 of the present disclosure, wherein example 11 also includes the subject matter according to any of examples 5 to 10, above.

Axial port 485 of outlet 480 of channel 408, being coaxial with rotational axis 438 of body 402, promotes flow of glutinous substance 168 from outlet 480 of channel 408 in direction coaxial with rotational axis 438 of body 402. In one example, axial port 485 of outlet 480 of channel 408, being coaxial with rotational axis 438 of body 402, facilitates delivery of glutinous substance 168 from outlet 480 of channel 408 to crown 421 of thatch 431 or second tips 429 of second tufts 427.

Cavity 444 of thatch 431 facilitates uniform distribution of glutinous substance 168 from outlet 480 to thatch 431. For example, glutinous substance 168 from outlet 480 collects within cavity 444 of thatch 431. Rotation of brush 400 urges, via centrifugal force, glutinous substance 168 within cavity 444 radially outward away from rotational axis 438 into uniform contact with thatch 431 along a length of thatch 431.

Referring generally to FIG. 1 and particularly to, e.g., FIG. 2, a portion of body 402 convergently tapers toward second end 411 of body 402 at first angle θ1 to rotational axis 438 of body 402. At least some of bristles 420 extend from body 402 at second angle θ2 to rotational axis 438 of body 402. First angle θ1 and second angle θ2 are equal. The preceding subject matter of this paragraph characterizes example 12 of the present disclosure, wherein example 12 also includes the subject matter according to any one of examples 1 to 11, above.

Convergently tapering the portion of body 402 toward second end 411 of body facilitates an increase in the difference, in any plane perpendicular to rotation axis 438 and intersecting thatch 431 and body 402, between first radius RB of thatch 431 and second radius RT of a portion of body 402, from base 424 of thatch 431 in a direction along rotational axis 438 toward crown 421 of thatch 431. The increase in the difference between first radius RB of thatch 431 and second radius RT of a portion of body 402 allows delivery of glutinous substance 168 to second surface 454 and third surface 452 of workpiece 170 while positioning body 402 away from second surface 454 and third surface 452 of workpiece 170. First angle θ1 and second angle θ2 being equal allows the difference between first radius RB of thatch 431 and second radius RT of a portion of body 402 to be proportional to first angle θ1 and second angle θ2. Body 402 includes head 406. In some examples, head 406 of body 402 convergently tapers and bristles 420 extend from surface 410 of head 406 of body 402.

Referring generally to FIG. 1 and particularly to, e.g., FIG. 2, a portion of body 402 convergently tapers toward second end 411 of body 402 at first angle θ1 to rotational axis 438 of body 402. At least some of bristles 420 extend from body 402 at second angle θ2 to rotational axis 438 of body 402. First angle θ1 and second angle θ2 are different. The preceding subject matter of this paragraph characterizes example 13 of the present disclosure, wherein example 13 also includes the subject matter according to any one of examples 1 to 11, above.

As presented above, convergently tapering the portion of body 402 toward second end 411 of body facilitates an increase in the difference, in any plane perpendicular to rotation axis 438 and intersecting thatch 431 and body 402, between first radius RB of thatch 431 and second radius RT of a portion of body 402, from base 424 of thatch 431 in a direction along rotational axis 438 toward crown 421 of thatch 431. First angle θ1 and second angle θ2 being different allows the difference between first radius RB of thatch 431 and second radius RT of a portion of body 402 to be disproportional to first angle θ1 or second angle θ2.

Referring generally to FIG. 1 and particularly to, e.g., FIG. 2, first angle θ1 is less than second angle θ2. The preceding subject matter of this paragraph characterizes example 14 of the present disclosure, wherein example 14 also includes the subject matter according to example 13, above.

First angle θ1 being less than second angle θ2 promotes a large difference between first radius RB of thatch 431 and second radius RT of a portion of body 402.

Referring generally to FIG. 1 and particularly to, e.g., FIGS. 2-7, a portion of body 402 is tapered and converges along rotational axis 438 toward second end 411 of body 402. The preceding subject matter of this paragraph characterizes example 15 of the present disclosure, wherein example 15 also includes the subject matter according to any one of examples 1 to 11, above.

Convergently tapering the portion of body 402 toward second end 411 of body facilitates an increase in the difference, in any plane perpendicular to rotation axis 438 and intersecting thatch 431 and body 402, between first radius RB of thatch 431 and second radius RT of a portion of body 402, from base 424 of thatch 431 in a direction along rotational axis 438 toward crown 421 of thatch 431.

Referring generally to FIG. 1 and particularly to, e.g., FIGS. 2-7, 13, and 14, bristles 420, extending from body 402 so that bristles 420 are not parallel to rotational axis 438, are arranged into thatch 431. The preceding subject matter of this paragraph characterizes example 16 of the present disclosure, wherein example 16 also includes the subject matter according to any one of examples 1 to 15, above.

Thatch 431 of bristles 420 promotes full and uniform coverage of glutinous substance 168 delivered to workpiece 170 from bristles 420 of thatch 431.

Referring generally to FIG. 1 and particularly to, e.g., FIGS. 8-12, bristles 420, extending from body 402 so that bristles 420 are not parallel to rotational axis 438, are arranged into first tufts 423. The preceding subject matter of this paragraph characterizes example 17 of the present disclosure, wherein example 17 also includes the subject matter according to any one of examples 1 to 4, above.

First tufts 423 promote full and uniform coverage of glutinous substance 168 delivered to workpiece 170 from bristles 420. Additionally, in some examples, first tufts 423 may facilitate ease in making brush 400 as first tufts 423 can be easier to assemble and couple to body 402 than thatch 431.

Referring generally to FIG. 1 and particularly to, e.g., FIGS. 8-12, each of first tufts 423 comprises first tip 425, parallel to rotational axis 438 of body 402. The preceding subject matter of this paragraph characterizes example 18 of the present disclosure, wherein example 18 also includes the subject matter according to example 17, above.

First tip 425 of each of first tufts 423, being parallel to rotational axis 438 of body 402 promotes delivery of glutinous substance 168 to surfaces of workpiece 170, such as third surface 452 of workpiece 170, parallel to rotational axis 438 of body 402.

Referring generally to FIG. 1 and particularly to, e.g., FIGS. 8-12, first tufts 423 extend from body 402 along paths 451, parallel to rotational axis 438 of body 402. The preceding subject matter of this paragraph characterizes example 19 of the present disclosure, wherein example 19 also includes the subject matter according to any one of examples 17 or 18, above.

Extending first tufts 423 from body 402 along paths 451, parallel to rotational axis 438 of body 402, facilitates full and uniform coverage of glutinous substance 168 delivered to workpiece 170 from bristles 420 of first tufts 423.

Figure 11:
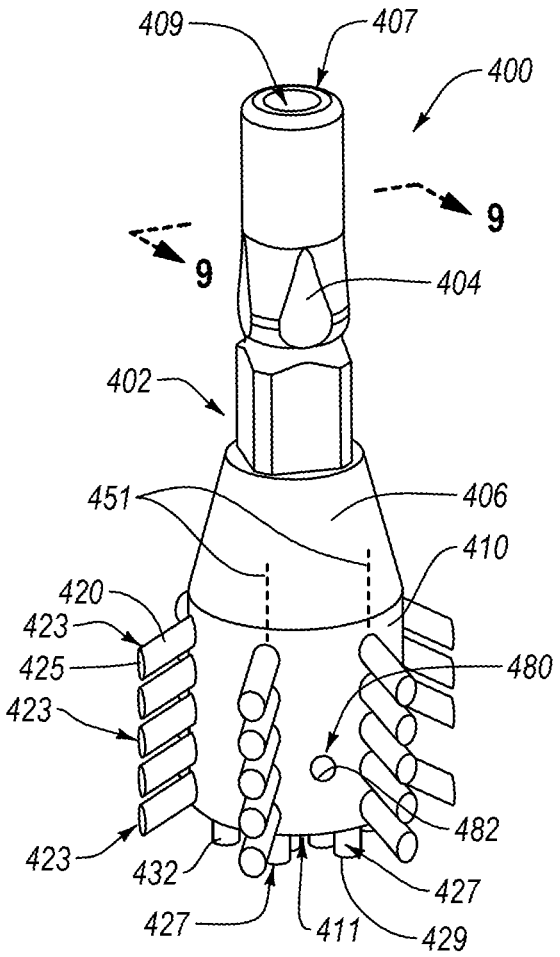

Referring generally to FIG. 1 and particularly to, e.g., FIG. 11, outlet 480 of channel 408 of body 402 comprises lateral port 482 between first end 407 of body 402 and second end 411 of body 402. Lateral port 482 is alongside and between two of paths 451, along which first tufts 423 extend from body 402. The preceding subject matter of this paragraph characterizes example 20 of the present disclosure, wherein example 20 also includes the subject matter according to example 19, above.

Lateral port 482, being alongside and between two of paths 451 along which first tufts 423 extend from body 402, facilitates full and uniform coverage of glutinous substance 168 delivered to workpiece 170 from bristles 420 of first tufts 423 by allowing first tufts 423 to be uniformly spaced along paths 451.

Figure 8:
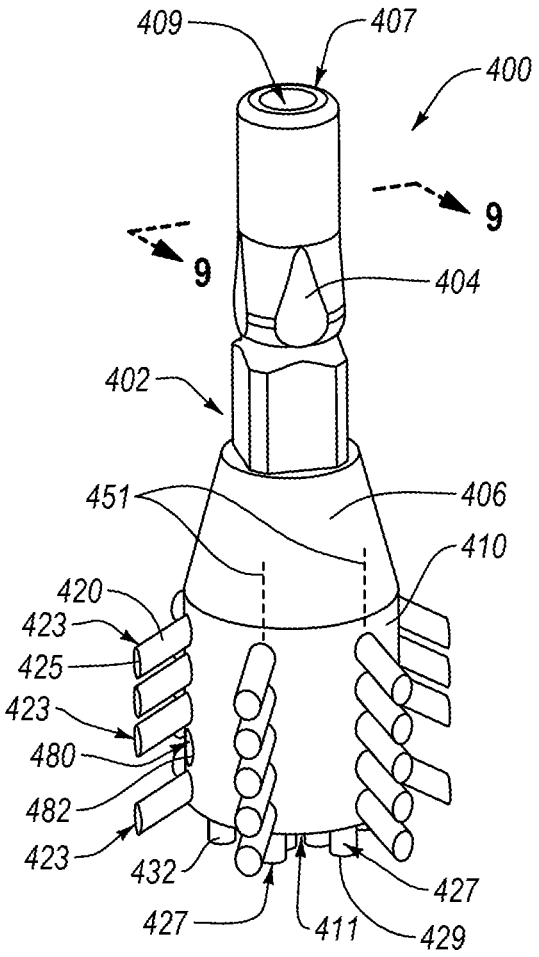
Figure 9:
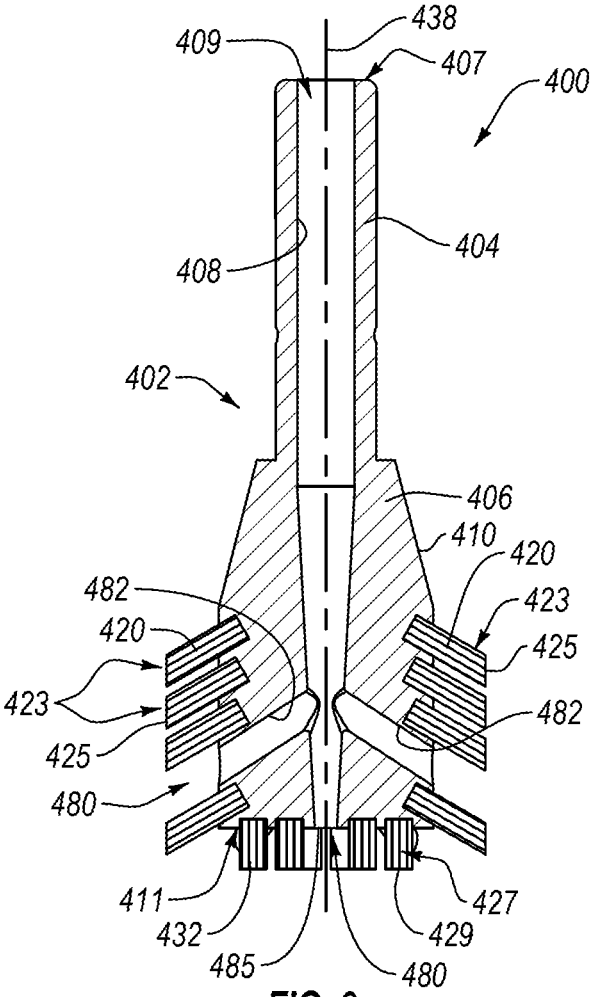
Figure 10:
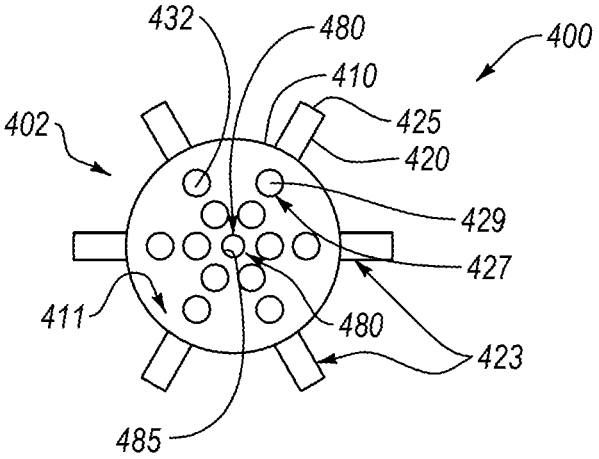

Referring generally to FIG. 1 and particularly to, e.g., FIGS. 8, 9, and 12, outlet 480 of channel 408 of body 402 comprises lateral port 482 between first end 407 of body 402 and second end 411 of body 402. Lateral port 482 is between two of first tufts 423 that extend from body 402 along one of paths 451, parallel to rotational axis 438 of body 402. The preceding subject matter of this paragraph characterizes example 21 of the present disclosure, wherein example 21 also includes the subject matter according to example 19, above.

Lateral port 482, being between two of first tufts 423, extending from body 402 along one of paths 451, parallel to rotational axis 438 of body 402, promotes efficient delivery of glutinous substance 168 from lateral port 482 of outlet 480 to bristles 420 of first tufts 423.

Referring generally to, e.g., FIG. 1 and particularly to FIGS. 8-14, brush 400 further comprises second bristles 432, extending, parallel to rotational axis 438 of body 402, from second end 411 of body 402. The preceding subject matter of this paragraph characterizes example 22 of the present disclosure, wherein example 22 also includes the subject matter according to any one of examples 1 to 4, above.

Second bristles 432 promote delivery of glutinous substance 168 to surfaces of workpiece 170, such as first surface 450 of workpiece 170, perpendicular to rotational axis 438 of body 402 and facing second end 411 of body 402.

Referring generally to, e.g., FIG. 1 and particularly to FIGS. 8-11 and 14, second bristles 432, extending, parallel to rotational axis 438 of body 402, from second end 411 of body 402, are arranged into second tufts 427. The preceding subject matter of this paragraph characterizes example 23 of the present disclosure, wherein example 23 also includes the subject matter according to example 22, above.

Second tufts 427 promote full and uniform coverage of glutinous substance 168 delivered to workpiece 170 from bristles 420. Additionally, in some examples, second tufts 427 may facilitate ease in making brush 400.

Referring generally to, e.g., FIG. 1 and particularly to FIGS. 8-11 and 14, each of second tufts 427 comprises second tip 429, perpendicular to rotational axis 438 of body 402. The preceding subject matter of this paragraph characterizes example 24 of the present disclosure, wherein example 24 also includes the subject matter according to example 23, above.

Second tip 429 of each of second tufts 427, being perpendicular to rotational axis 438 of body 402, promotes delivery of glutinous substance 168 to surfaces of workpiece 170, such as first surface 450 of workpiece 170, perpendicular to rotational axis 438 of body 402 and facing second end 411 of body 402.

Referring generally to, e.g., FIG. 1 and particularly to FIGS. 12 and 13, second bristles 432, extending, parallel to rotational axis 438 of body 402, from second end 411 of body 402, are arranged into thatch 431. The preceding subject matter of this paragraph characterizes example 25 of the present disclosure, wherein example 25 also includes the subject matter according to example 22, above.

Thatch 431 of bristles 420 promotes full and uniform coverage of glutinous substance 168 delivered to workpiece 170 from bristles 420 of thatch 431.

Figure 6:
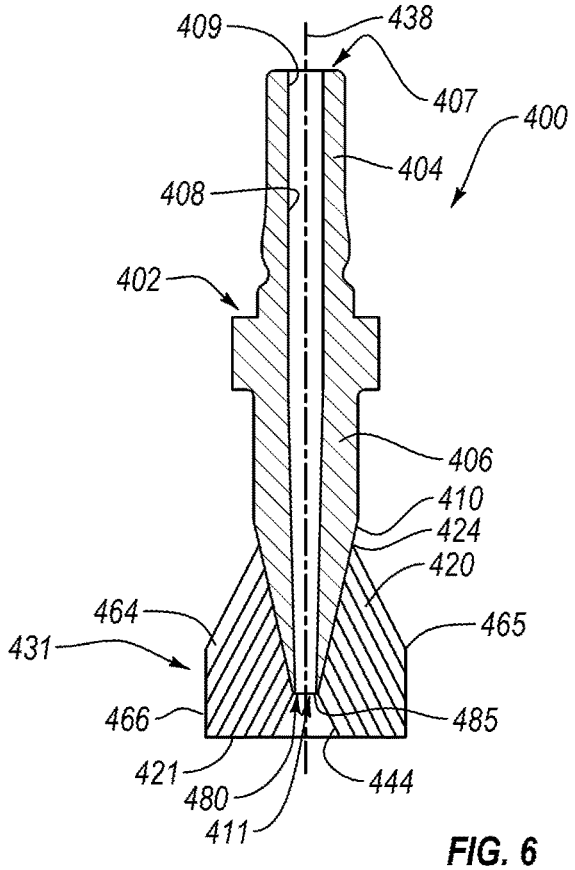
Figure 7:
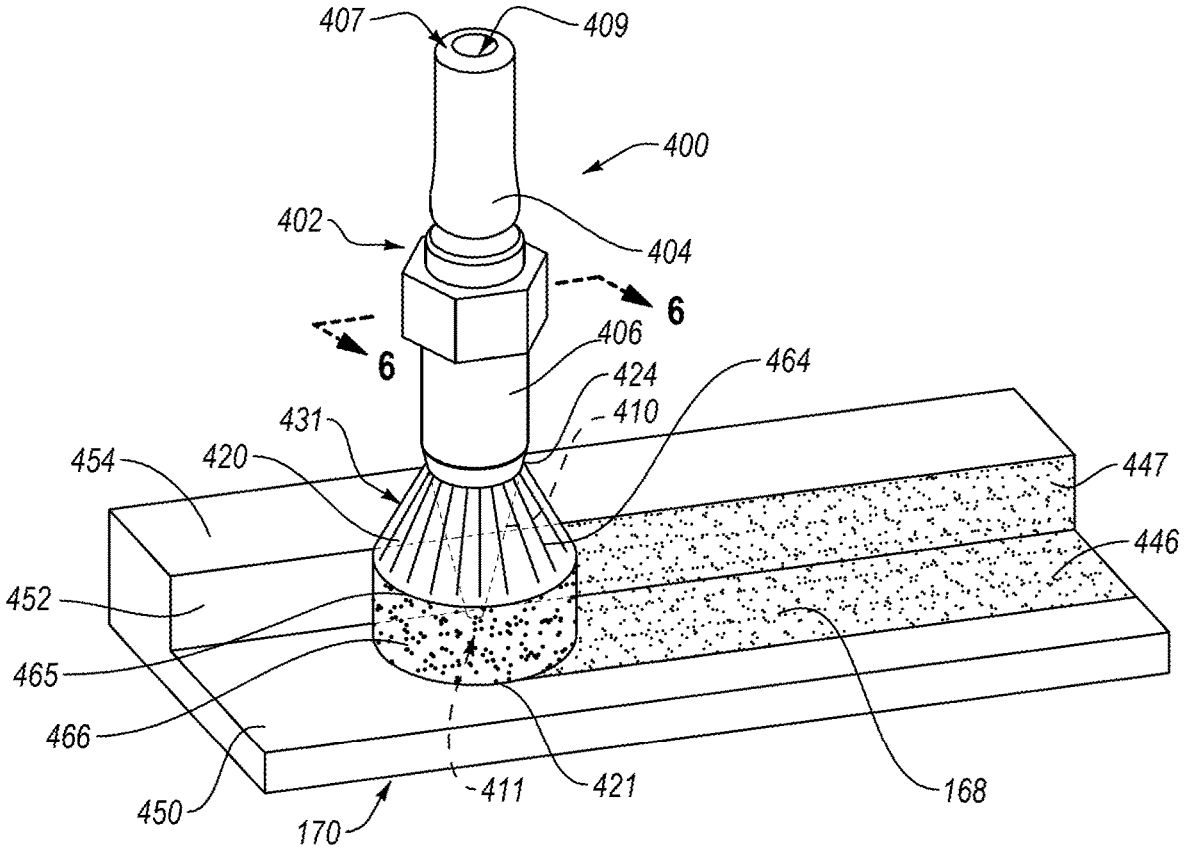

Referring generally to, e.g., FIG. 1 and particularly to FIGS. 6 and 9, at least a portion of channel 408 of body 402 convergently tapers along rotational axis 438 toward second end 411 of body 402. The preceding subject matter of this paragraph characterizes example 26 of the present disclosure, wherein example 26 also includes the subject matter according to any one of examples 1 to 25, above.

Convergently tapering at least a portion of channel 408 of body 402 along rotational axis 438 toward second end 411 of body 402 promotes acceleration of glutinous substance 168 flowing through the convergently tapered portion of channel 408 of body 402.

Referring generally to, e.g., FIG. 1 and particularly to FIG. 13, bristles 420 extend from body 402 orthogonally to rotational axis 438 of body 402. The preceding subject matter of this paragraph characterizes example 27 of the present disclosure, wherein example 27 also includes the subject matter according to any one of examples 1 to 11, 13 to 15, or 17 to 26, above.

Bristles 420, extending from body 402 orthogonally to rotational axis 438 of body 402, promotes delivery of glutinous substance 168 to surfaces of workpiece 170, such as third surface 452 of workpiece 170, parallel to rotational axis 438 of body 402.

Referring generally to, e.g., FIG. 1 and particularly to FIGS. 2-9, 11, 12, and 14, bristles 420 extend from body 402 obliquely to rotational axis 438 of body 402. The preceding subject matter of this paragraph characterizes example 28 of the present disclosure, wherein example 28 also includes the subject matter according to any one of examples 1 to 26, above.

Bristles 420, extending obliquely to rotational axis 438 of body 402, promote delivery of glutinous substance 168 to non-coplanar surfaces that are parallel to and separated, or offset, from each other.

Referring generally to, e.g., FIGS. 2-7 and 14 and particularly to FIG. 15, method 500 of making brush 400 is disclosed. Method 500 comprises (block 502) attaching bristles 420 to body 402 such that bristles 420 are not parallel to rotational axis 438 of body 402. Body 402 comprises first end 407, second end 411, opposite first end 407, and channel 408, comprising axial inlet 409 and outlet 480. Axial inlet 409 is at first end 407 of body 402 and is coaxial with rotational axis 438. Method 500 also comprises (block 504) removing first portions of at least a plurality of bristles 420 to form thatch 431 that comprises frusto-conical portion 464 and cylindrical portion 466. The preceding subject matter of this paragraph characterizes example 29 of the present disclosure.

Method 500 facilitates the making of brush 400 that is configured to facilitate ease and efficiency associated with the application of glutinous substances onto surfaces of workpieces. Axial inlet 409 being coaxial with rotational axis 438 allows flow of glutinous substance 168 through channel 408 as brush 400 rotates about rotational axis 438. Bristles 420, extending from body 402 so that bristles 420 are not parallel to rotational axis 438 of body 402, promote concurrent application of glutinous substance 168 onto non-coplanar surfaces. Removing first portions of at least a plurality of bristles 420 to form thatch 431 promotes ease in forming thatch 431. For example, removing first portions of at least a plurality of bristles 420, after bristles 420 are coupled to body 402 and arranged in thatch 431, to form frusto-conical portion 464 and cylindrical portion 466 of thatch 431 promotes accurate, precise, and simplified formation of frusto-conical portion 464 and cylindrical portion 466 of thatch 431. Frusto-conical portion 464 and cylindrical portion 466 of thatch 431 facilitate delivery of glutinous substance 168 to non-coplanar surfaces of workpiece 170. More specifically, in one example, frusto-conical portion 464 promotes delivery of glutinous substance 168 to second surface 454 of workpiece 170, and cylindrical portion 466 promotes delivery of glutinous substance 168 to first surface 450 and third surface 452 of workpiece 170, where third surface 452 of workpiece 170 separates first surface 450 of workpiece 170 from second surface 454 of workpiece 170.

Referring generally to, e.g., FIGS. 2-7 and 14 and particularly to FIG. 15, according to method 500, removing the first portions of at least the plurality of bristles 420 comprises (block 506) burning away the first portions of at least the plurality of bristles 420 so that second precursor portions of at least the plurality of the bristles 420 remain attached to body 402. The second precursor portion comprises melted ends. The preceding subject matter of this paragraph characterizes example 30 of the present disclosure, wherein example 30 also includes the subject matter according to example 29, above.

Burning away the first portions of at least the plurality of bristles 420 provides an efficient, inexpensive, and labor-reducing way to remove the first portions of at least the plurality of bristles 420 to form frusto-conical portion 464 and cylindrical portion 466 of thatch 431.

Referring generally to, e.g., FIGS. 2-7 and 14 and particularly to FIG. 15, according to method 500, removing the first portions of at least the plurality of bristles 420 further comprises (block 508) rubbing away the melted ends of the second precursor portions of at least the plurality of bristles 420 using an abrasive surface. The preceding subject matter of this paragraph characterizes example 31 of the present disclosure, wherein example 31 also includes the subject matter according to example 30, above.

Rubbing the melted ends of the second precursor portions of at least the plurality of bristles 420 using the abrasive surface facilitates the precise removal of the melted ends of the second precursor portions from at least the plurality of bristles 420.

The abrasive surface can be any of various surfaces having friction-inducing features, such as relative sharp surface undulations or protuberances. In some examples, the abrasive surface is sand paper having a grit sufficient to remove the melted ends of the second precursor portions of at least the plurality of bristles 420. Rubbing away the melted ends of the second precursor portions of at least the plurality of bristles 420 using the abrasive surface may include positioning the melted ends in contact with the abrasive surface, and while in contact, repeatedly moving the melted ends back and forth along the abrasive surface with enough force that only the melted ends are removed from the second precursor portions.

Referring generally to, e.g., FIGS. 2-7 and 14 and particularly to FIG. 15, according to method 500, (block 510) the first portions of at least the plurality of bristles 420 are burned away with a laser beam. The preceding subject matter of this paragraph characterizes example 32 of the present disclosure, wherein example 32 also includes the subject matter according to any one of examples 30 or 31, above.

Using a laser beam to burn away the first portions of at least the plurality of bristles 420 promotes accurate and precise formation of frusto-conical portion 464 and cylindrical portion 466 of thatch 431.

Referring generally to, e.g., FIGS. 2-7 and 14 and particularly to FIG. 15, according to method 500, (block 512) the first portions of at least the plurality of bristles 420 are burned away using a heated surface. The preceding subject matter of this paragraph characterizes example 33 of the present disclosure, wherein example 33 also includes the subject matter according to any one of examples 30 to 31, above.

Burning away the first portions of at least the plurality of bristles 420 using a heated surface facilitates accurate and precise formation of frusto-conical portion 464 and cylindrical portion 466 of thatch 431. Additionally, using a heated surface to burn away the first portions of at least the plurality of bristles 420 promotes efficiency when forming frusto-conical portions 464 and cylindrical portions 466 of thatches 431 of multiple brushes 400 in a repetitive process.

In some examples, the heated surface can be a surface of any of various objects made of a thermally conductive material heated to a temperature sufficient to controllably melt or burn bristles 420. In one example, the heated surface is made of a metal, such as steel, brass, and the like. According to an example, the heated surface is a heated surface of a branding-iron-type object.

Referring generally to FIGS. 2-7 and 14 and particularly to, e.g., FIG. 15, according to method 500, removing the first portions of at least the plurality of bristles 420 comprises (block 514) cutting away the first portions of at least the plurality of bristles 420. The preceding subject matter of this paragraph characterizes example 34 of the present disclosure, wherein example 34 also includes the subject matter according to example 29, above.

Cutting away the first portions of at least the plurality of bristles 420 to remove the first portions of at least the plurality of bristles 420 promotes clean and precise removal of the first portions of at least the plurality of bristles 420.

Referring generally to 2-7 and 14 and particularly to, e.g., FIG. 15, according to method 500, removing the first portions of at least the plurality of bristles 420 to form thatch 431 comprises (block 516) removing the first portions of at least the plurality of bristles 420 along directions parallel to rotational axis 438 of body 402. The preceding subject matter of this paragraph characterizes example 35 of the present disclosure, wherein example 35 also includes the subject matter according to any one of examples 29 to 34, above.

Removing the first portions of at least the plurality of bristles 420 along directions parallel to rotational axis 438 of body 402 facilitates ease in forming frusto-conical portion 464 and cylindrical portion 466 of thatch 431. For example, bristles 420, having uniform or different lengths, can be first coupled to body 402 at oblique angle to rotational axis 438 of body 402, and then trimmed along directions parallel to rotational axis 438 of body 402, circumferentially about thatch 431 at uniform radii from rotational axis 438.

Referring generally to FIG. 4 and particularly to, e.g., FIG. 16, method 600 of delivering glutinous substance 168 to workpiece 170 from end-effector 102 is disclosed. Workpiece 170 comprises first surface 450, second surface 454, spaced normal distance H from first surface 450, and third surface 452, separating first surface 450 from second surface 454. Method 600 comprises (block 602) using end-effector 102 to rotate brush 400 relative to workpiece 170 about rotational axis 438. Brush 400 comprises body 402, comprising first end 407, second end 411, opposing first end 407, and channel 408, comprising axial inlet 409 and outlet 480. Axial inlet 409 is at first end 407 of body 402 and is coaxial with rotational axis 438. Brush 400 also comprises bristles 420, extending from body 402 so that bristles 420 are not parallel to rotational axis 438 of body 402. Bristles 420 are arranged into thatch 431, comprising frusto-conical portion 464, cylindrical portion 466, boundary 465 between frusto-conical portion 464 and cylindrical portion 466, and crown 421, which is opposite first end 407 of body 402. Cylindrical portion 466 of thatch 431 terminates at crown 421 of thatch 431. Additionally, method 600 comprises (block 604), while rotating brush 400 relative to workpiece 170 about rotational axis 438, urging glutinous substance 168 from end-effector 102 through channel 408 of body 402 of brush 400 from axial inlet 409 of channel 408 to outlet 480 of channel 408, into contact with thatch 431. Method 600 further comprises (block 606) using end-effector 102 to position brush 400 relative to workpiece 170 such that glutinous substance 168 in contact with thatch 431 is delivered onto at least first surface 450 and third surface 452 of workpiece 170. The preceding subject matter of this paragraph characterizes example 36 of the present disclosure.

Method 600 facilitates delivery of glutinous substance 168 to workpiece 170 from end-effector 102 using brush 400 that is configured to facilitate ease and efficiency of the delivery of glutinous substance 168 onto surfaces of workpieces. Axial inlet 409 being coaxial with rotational axis 438 allows flow of glutinous substance 168 through channel 408 as brush 400 rotates about rotational axis 438. Bristles 420, extending from body 402 so that bristles 420 are not parallel to rotational axis 438 of body 402, promote concurrent application of glutinous substance 168 onto non-coplanar surfaces. Rotating brush 400 while urging glutinous substance 168 through channel 408 and into contact with thatch 431 helps to uniformly deliver glutinous substance 168 to bristles 420 of thatch 431.

Referring generally to FIG. 4 and particularly to, e.g., FIG. 16, method 600 further comprises (block 614), while rotating brush 400 about rotational axis 438 and positioning brush 400 relative to workpiece 170 such that glutinous substance 168 in contact with thatch 431 is delivered onto at least first surface 450 and third surface 452 of workpiece 170, moving brush 400 along workpiece 170. The preceding subject matter of this paragraph characterizes example 37 of the present disclosure, wherein example 37 also includes the subject matter according to example 36, above.

Moving brush 400 along workpiece 170, while rotating brush 400 about rotational axis 438 and positioning brush 400 relative to workpiece 170 such that glutinous substance 168 in contact with thatch 431 is delivered onto at least first surface 450 and third surface 452 of workpiece 170, facilitates the delivery of glutinous substance 168 to areas of workpiece 170 larger than brush 400. For example, brush 400 can be moved along a seam between two interconnected parts of workpiece 170 to deliver glutinous substance 168 along a length of the seam and a length of portions of workpiece 170 adjacent the seam.

Referring generally to FIG. 4 and particularly to, e.g., FIG. 16, according to method 600, (block 608) when glutinous substance 168 in contact with thatch 431 is delivered onto at least first surface 450 and third surface 452 of workpiece 170 by bristles 420, second end 411 of body 402 of brush 400 is third distance D3 from first surface 450 of workpiece 170 along rotational axis 438 of body 402 of brush 400. Third distance D3 is less than normal distance H between first surface 450 and second surface 454 of workpiece 170. The preceding subject matter of this paragraph characterizes example 38 of the present disclosure, wherein example 38 also includes the subject matter according to any one of examples 36 or 37, above.

Second end 411 of body 402 of brush 400, being third distance D3, which is less than normal distance H between first surface 450 and second surface 454 of workpiece 170, from first surface 450 of workpiece 170 when glutinous substance 168 in contact with thatch 431 is delivered onto at least first surface 450 and third surface 452 of workpiece 170 by bristles 420, promotes accurate and quality deliverance of glutinous substance 168 onto at least first surface 450 and third surface 452.

Referring generally to FIG. 4 and particularly to, e.g., FIG. 16, according to method 600, (block 610) when glutinous substance 168 in contact with thatch 431 is delivered onto only first surface 450 and third surface 452 of workpiece 170 by bristles 420, boundary 465 between frusto-conical portion 464 and cylindrical portion 466 of thatch 431 is second distance D2 from first surface 450 of workpiece 170 along rotational axis 438 of body 402 of brush 400. Second distance D2 is less than normal distance H between first surface 450 and second surface 454 of workpiece 170. The preceding subject matter of this paragraph characterizes example 39 of the present disclosure, wherein example 39 also includes the subject matter according to any one of examples 36 to 38, above.

Positioning brush 400 relative to workpiece 170 such that second distance D2 is less than normal distance H between first surface 450 and second surface 454 of workpiece 170 facilitates positioning tips of all bristles 420 of thatch 431 below second surface 454 of workpiece 170. With tips of bristles 420 of thatch 431 below second surface 454 of workpiece 170, delivery of glutinous substance 168 onto second surface 454 of workpiece 170 is prevented.

Referring generally to FIG. 4 and particularly to, e.g., FIG. 16, according to method 600, (block 612) when glutinous substance 168 in contact with thatch 431 is delivered onto first surface 450, second surface 454, and third surface 452 of workpiece by bristles 420, boundary 465 between frusto-conical portion 464 and cylindrical portion 466 of thatch 431 is second distance D2 from first surface 450 of workpiece 170 along rotational axis 438 of body 402 of brush 400. Second distance D2 is greater than normal distance H between first surface 450 and second surface 454 of workpiece 170. The preceding subject matter of this paragraph characterizes example 40 of the present disclosure, wherein example 40 also includes the subject matter according to any one of examples 36 to 38, above.

Positioning brush 400 relative to workpiece 170 such that second distance D2 is greater than normal distance H between first surface 450 and second surface 454 of workpiece 170 facilitates positioning tips of at least some bristles 420 of thatch 431 above second surface 454 of workpiece 170. With tips of some bristles 420 of thatch 431 above second surface 454 of workpiece 170, delivery of glutinous substance 168 onto second surface 454 of workpiece 170 is provided.

Examples of the present disclosure may be described in the context of aircraft manufacturing and service method 1100 as shown in FIG. 17 and aircraft 1102 as shown in FIG. 18. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 18, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A method (600) of delivering a glutinous substance (168) to a workpiece (170) from an end-effector (102), wherein the workpiece (170) comprises a first surface (450), a second surface (454), spaced a normal distance (H) from the first surface (450), and a third surface (452), separating the first surface (450) from the second surface (454), the method (600) comprising:

using the end-effector (102) to rotate a brush (400) relative to the workpiece (170) about a rotational axis (438) of the brush (400), wherein the brush (400) comprises:

a body (402), comprising:

a first end (407);

a second end (411), opposing the first end (407); and a channel (408), comprising an axial inlet (409) and an outlet (480), wherein the axial inlet (409) is at the first end (407) of the body (402) and is coaxial with the rotational axis (438) of the body (402) of the brush (400); and bristles (420), extending from the body (402) so that the bristles (420) are not parallel to the rotational axis (438) of the body (402) of the brush (400), wherein:

the bristles (420) are arranged into a thatch (431), comprising a frusto-conical portion (464), a cylindrical portion (466), a boundary (465) between the frusto-conical portion (464) and the cylindrical portion (466), and a crown (421), which is opposite the first end (407) of the body (402); and the cylindrical portion (466) of the thatch (431) terminates at the crown (421) of the thatch (431);

while rotating the brush (400) relative to the workpiece (170) about the rotational axis (438) of the body (402) of the brush (400), urging the glutinous substance (168) from the end-effector (102) through the channel (408) of the body (402) of the brush (400) from the axial inlet (409) of the channel (408) to the outlet (480) of the channel (408), into contact with the thatch (431); and using the end-effector (102) to position the brush (400) relative to the workpiece (170) such that the glutinous substance (168) in contact with the thatch (431) is delivered onto at least the first surface (450) and the third surface (452) of the workpiece (170) by the bristles (420).

2. The method (600) according to claim 1, further comprising, while rotating the brush (400) about the rotational axis (438) of the body (402) of the brush (400) and positioning the brush (400) relative to the workpiece (170) such that the glutinous substance (168) in contact with the thatch (431) is delivered onto at least the first surface (450) and the third surface (452) of the workpiece (170), moving the brush (400) along the workpiece (170).

3. The method (600) according to claim 1, wherein, when the glutinous substance (168) in contact with the thatch (431) is delivered onto at least the first surface (450) and the third surface (452) of the workpiece (170) by the bristles (420):

the second end (411) of the body (402) of the brush (400) is a third distance (D3) from the first surface (450) of the workpiece (170) along the rotational axis (438) of the body (402) of the brush (400); and the third distance (D3) is less than the normal distance (H) between the first surface (450) and the second surface (454) of the workpiece (170).

4. The method (600) according to claim 1, wherein:

the glutinous substance (168) in contact with the thatch (431) is delivered onto only the first surface (450) and the third surface (452) of the workpiece (170) by the bristles (420); and when the glutinous substance (168) in contact with the thatch (431) is delivered onto only the first surface (450) and the third surface (452) of the workpiece (170) by the bristles (420):

the boundary (465) between the frusto-conical portion (464) and the cylindrical portion (466) of the thatch (431) is a second distance (D2) from the first surface (450) of the workpiece (170) along the rotational axis (438) of the body (402) of the brush (400); and the second distance (D2) is less than the normal distance (H) between the first surface (450) and the second surface (454) of the workpiece (170).

5. The method (600) according to claim 1, wherein:

the glutinous substance (168) in contact with the thatch (431) is delivered onto the first surface (450), the second surface (454), and the third surface (452) of the workpiece by the bristles (420), and when the glutinous substance (168) in contact with the thatch (431) is delivered onto the first surface (450), the second surface (454), and the third surface (452) of the workpiece by the bristles (420):

the boundary (465) between the frusto-conical portion (464) and the cylindrical portion (466) of the thatch (431) is a second distance (D2) from the first surface (450) of the workpiece (170) along the rotational axis (438) of the body (402) of the brush (400); and the second distance (D2) is greater than the normal distance (H) between the first surface (450) and the second surface (454) of the workpiece (170).

6. The method (600) according to claim 2, wherein, when the glutinous substance (168) in contact with the thatch (431) is delivered onto at least the first surface (450) and the third surface (452) of the workpiece (170) by the bristles (420):

the second end (411) of the body (402) of the brush (400) is a third distance (D3) from the first surface (450) of the workpiece (170) along the rotational axis (438) of the body (402) of the brush (400); and the third distance (D3) is less than the normal distance (H) between the first surface (450) and the second surface (454) of the workpiece (170).

7. The method (600) according to claim 2, wherein:

the glutinous substance (168) in contact with the thatch (431) is delivered onto only the first surface (450) and the third surface (452) of the workpiece (170) by the bristles (420); and when the glutinous substance (168) in contact with the thatch (431) is delivered onto only the first surface (450) and the third surface (452) of the workpiece (170) by the bristles (420):

the boundary (465) between the frusto-conical portion (464) and the cylindrical portion (466) of the thatch (431) is a second distance (D2) from the first surface (450) of the workpiece (170) along the rotational axis (438) of the body (402) of the brush (400); and the second distance (D2) is less than the normal distance (H) between the first surface (450) and the second surface (454) of the workpiece (170).

8. The method (600) according to claim 3, wherein:

the glutinous substance (168) in contact with the thatch (431) is delivered onto only the first surface (450) and the third surface (452) of the workpiece (170) by the bristles (420); and when the glutinous substance (168) in contact with the thatch (431) is delivered onto only the first surface (450) and the third surface (452) of the workpiece (170) by the bristles (420):

the boundary (465) between the frusto-conical portion (464) and the cylindrical portion (466) of the thatch (431) is a second distance (D2) from the first surface (450) of the workpiece (170) along the rotational axis (438) of the body (402) of the brush (400); and the second distance (D2) is less than the normal distance (H) between the first surface (450) and the second surface (454) of the workpiece (170).

9. The method (600) according to claim 2, wherein:

the glutinous substance (168) in contact with the thatch (431) is delivered onto the first surface (450), the second surface (454), and the third surface (452) of the workpiece by the bristles (420); and when the glutinous substance (168) in contact with the thatch (431) is delivered onto the first surface (450), the second surface (454), and the third surface (452) of the workpiece by the bristles (420):

the boundary (465) between the frusto-conical portion (464) and the cylindrical portion (466) of the thatch (431) is a second distance (D2) from the first surface (450) of the workpiece (170) along the rotational axis (438) of the body (402) of the brush (400); and the second distance (D2) is greater than the normal distance (H) between the first surface (450) and the second surface (454) of the workpiece (170).

10. The method (600) according to claim 3, wherein:

the glutinous substance (168) in contact with the thatch (431) is delivered onto the first surface (450), the second surface (454), and the third surface (452) of the workpiece by the bristles (420); and when the glutinous substance (168) in contact with the thatch (431) is delivered onto the first surface (450), the second surface (454), and the third surface (452) of the workpiece by the bristles (420):

the boundary (465) between the frusto-conical portion (464) and the cylindrical portion (466) of the thatch (431) is a second distance (D2) from the first surface (450) of the workpiece (170) along the rotational axis (438) of the body (402) of the brush (400); and the second distance (D2) is greater than the normal distance (H) between the first surface (450) and the second surface (454) of the workpiece (170).

11. The method (600) according to claim 1, wherein the first surface (450) of the workpiece (170) is perpendicular to the third surface (452) of the workpiece (170).

12. The method (600) according to claim 11, wherein the third surface (452) of the workpiece (170) is parallel to the rotational axis (438) of the body (402) of the brush (400).

13. The method (600) according to claim 4, wherein the first surface (450) of the workpiece (170) is perpendicular to the third surface (452) of the workpiece (170).

14. The method (600) according to claim 5, wherein the first surface (450) of the workpiece (170) is perpendicular to the third surface (452) of the workpiece (170).

15. The method (600) according to claim 14, wherein the first surface (450) of the workpiece (170) is parallel to the second surface (454) of the workpiece (170).

16. The method (600) according to claim 1, wherein:

the thatch (431) further comprises a base (424), located between the crown (421) and the first end (407) of the body (402) of the workpiece (400);

the frusto-conical portion (464) originates at the base (424) of the thatch (431);

the cylindrical portion (466) terminates at the crown (421) of the thatch (431);

the cylindrical portion (466) is contiguous with the frusto-conical portion (464);

a portion of the body (402), from which the bristles (420) extend, is tapered and converges from the base (424) of the thatch (431) to the second end (411) of the body (402) of the brush (400) in a direction along the rotational axis (438) of the body (402) of the brush (400) toward the second end (411) of the body (402) of the brush (400); and the channel (408) of the body (402) of the brush (400) is a solid cylinder that is hollow in its entirety.

17. The method (600) according to claim 1, wherein:

the outlet (480) of the channel (408) of the body (402) comprises an axial port (485), located at the second end (411) of the body (402) of the brush (400); and the axial port (485) is coaxial with the rotational axis (438) of the body (402) of the brush (400).

18. The method (600) according to claim 1, wherein the outlet (480) of the channel (408) of the body (402) of the brush (400) comprises a lateral port (482) between the first end (407) of the body (402) of the brush (400) and the second end (411) of the body (402) of the brush (400).

19. The method (600) according to claim 1, wherein:

the thatch (431) further comprises a base (424), located between the crown (421) and the first end (407) of the body (402) of the brush (400);

the cylindrical portion (466) terminates at the crown (421) of the thatch (431);

the cylindrical portion (466) is contiguous with the frusto-conical portion (464);

a first radius (RB) of the cylindrical portion (466) of the thatch (431) is constant from the frusto-conical portion (464) of the thatch (431) to the crown (421) of the thatch (431); and the channel (408) of the body (402) of the brush (400) is a solid cylinder that is hollow in its entirety.

20. The method (600) according to claim 1, wherein:

all the bristles (420), extending from the body, extend from the body (402) at identical angles relative to the rotational axis (438) of the body (402) of the brush (400);

the outlet (480) of the channel (408) of the body (402) comprises an axial port (485), located at the second end (411) of the body (402) of the brush (400);

the axial port (485) is coaxial with the rotational axis (438) of the body (402) of the brush (400);

the outlet (480) of the channel (408) of the body (402) further comprises a lateral port (482) between the first end (407) of the body (402) of the brush (400) and the second end (411) of the body (402) of the brush (400); and the axial port (485) is open to the lateral port (482) to allow the glutinous substance (168) to flow concurrently through both the axial port (485) and the lateral port (482).

* * * * *